US012116539B2

(12) United States Patent
Kouris et al.

(10) Patent No.: US 12,116,539 B2
(45) Date of Patent: Oct. 15, 2024

(54) COMPOSITION COMPRISING HEAVY PETROLEUM OIL

(71) Applicant: VERTORO B.V., Geleen (NL)

(72) Inventors: Panagiotis Kouris, Geleen (NL); Michael Dirk Boot, Geleen (NL)

(73) Assignee: VERTORO B.V., Geleen (NL)

( * ) Notice: Subject to any disclaimer, the term of this patent is extended or adjusted under 35 U.S.C. 154(b) by 0 days.

(21) Appl. No.: 18/557,982

(22) PCT Filed: Apr. 28, 2022

(86) PCT No.: PCT/EP2022/061365
§ 371 (c)(1),
(2) Date: Oct. 30, 2023

(87) PCT Pub. No.: WO2022/229333
PCT Pub. Date: Nov. 3, 2022

(65) Prior Publication Data

US 2024/0218275 A1 Jul. 4, 2024

(30) Foreign Application Priority Data

Apr. 30, 2021 (EP) ..... 21171656

(51) Int. Cl.
*C10L 1/00* (2006.01)
*C10L 1/14* (2006.01)

(52) U.S. Cl.
CPC ..... *C10L 1/143* (2013.01); *C10L 2200/0453* (2013.01); *C10L 2250/04* (2013.01); *C10L 2290/24* (2013.01); *C10L 2290/544* (2013.01)

(58) Field of Classification Search
CPC ..... C10L 1/143; C10L 2200/0453; C10L 2250/04; C10L 2290/24; C10L 2290/544
See application file for complete search history.

(56) References Cited

FOREIGN PATENT DOCUMENTS

| | | | | |
|---|---|---|---|---|
| CN | 101724475 | A | 6/2010 | |
| CN | 101955832 | A | 1/2011 | |
| FR | 2938838 | A1 * | 5/2010 | ..... C07C 231/06 |
| RU | 2129142 | C1 | 4/1999 | |
| SE | 1951187 | A1 | 10/2019 | |
| WO | 2019053287 | A1 | 3/2019 | |
| WO | 2021064047 | A1 | 4/2021 | |

OTHER PUBLICATIONS

FR-2938838-A1; May 2010 (Year: 2010).*

* cited by examiner

*Primary Examiner* — Ellen M McAvoy
*Assistant Examiner* — Chantel Graham
(74) *Attorney, Agent, or Firm* — Hudak, Shunk & Farine Co. LPA

(57) ABSTRACT

A composition including a heavy petroleum oil and a lignin oil containing lignin oligomers and methylated sugars.

23 Claims, 5 Drawing Sheets

GPC of the methylated C5 sugar fraction of the lignin oil of Example 4

GPC of the methylated C5 sugar fraction of the lignin oil of Example 4

COMPOSITION COMPRISING HEAVY PETROLEUM OIL

FIELD OF THE INVENTION

The present invention relates to a blend comprising a heavy petroleum oil and a process for the preparation thereof.

BACKGROUND OF THE INVENTION

International shipping emits around 940 million tons of $CO_2$ annually and is responsible for approximately 2.5% of global greenhouse gas emissions. By far the most consumed fuel is so-called heavy fuel oil (HFO). To address this issue, there have been many attempts at blending biomass derivatives, notably lignin with heavy fuel oil. A recurring technical challenge here relates to blend stability, given that there is a polarity mismatch between apolar HFO and polar lignin.

Approaches to overcome this challenge included particle size reduction of the lignin. For instance, CN 101955832 describes a method for producing a nonhomogeneous fuel mixture, i.e. dispersion, comprising tiny or nano particle-shaped solid combustible substances, such as lignin and HFO, amongst other fuels. Another approach described in CN 101724475 is mechanical in nature, utilizing continuous stirring to maintain a stable dispersion between lignin particles and HFO. A third solution is to promote a more stable dispersion by increasing the temperature of the HFO, for example to 80-150 C, as proposed in RU 2129142. A fourth approach involves the use of a dispersant or a dispersion agent, which improves the separation of the particles and to prevent their settling or clumping.

SUMMARY OF THE INVENTION

It is an object of the present invention to provide a blend of a biomass derived lignin oil and a heavy petroleum oil such as HFO, VGO (vacuum gas oil) and lubrication oil in which the above-mentioned and/or other problems are solved.

Accordingly, the present invention provides a composition comprising a heavy petroleum oil and a lignin oil containing lignin oligomers and methylated sugars.

The present invention further provides use of a methylated sugar for improving the dispersion of a blend of a heavy petroleum oil and lignin oligomers.

It was surprisingly found that the methylated sugar increases the dispersion of a blend of a heavy petroleum oil and lignin, resulting in less or smaller particles. Thus, the presence of such methylated sugars allows preparation of a more stable blend comprising a heavy petroleum oil and lignin; improving therefore homogeneity. Accordingly, the present invention provides a more environmentally friendly blend which can be used instead of a pure heavy petroleum oil.

Heavy Petroleum Oil

Preferably, the heavy petroleum oil is selected from heavy fuel oil, vacuum gas oil, lubrication oil and mixtures thereof.

Examples of the fields of use of these types of the heavy petroleum oil are:

HFO: biofuel component

VGO: bio (FCC) cracker feedstock component

Lubrication oils: biolubrication component

Lignin Oil

The lignin oil comprises methylated sugars and a lignin oligomer.

In an embodiment, the ratio (w/w) of lignin oligomers to methylated sugars in the lignin oil ranges between 1:1 and 2.5:1, preferably between 1.6:1 and 2:1.

Methylated Sugars

Preferably, the methylated sugars comprise methylated C5 sugars and optionally methylated C6 sugars. Preferably, the methylated sugar used according to the invention is selected from methyl-pentopyranoside, methyl-D-glucopyranoside, methyl-D-xylopyranoside, methyl 3-O-acetylpentopyranoside, dimethyl-4-O-methyl-hexanopyroside and mixtures thereof.

At least 50 wt. % of the methylated sugars are methylated C5 sugars, preferably at least 55 or 60 wt. %.

The methylated sugars can be monomeric, dimeric or oligomeric.

Lignin Oligomer

Preferably, the lignin oligomer has a number average molecular mass (Mn) between 400 and 1000 g/mol.

The composition comprises little or no amount of alcohols selected from methanol, ethanol and butanol. Preferably, the total amount of said alcohols is at most 1 wt. % with respect to the composition.

Preferably, the amount of the lignin oil is 0.1 wt. % to 30 wt. % with respect to the composition, more preferably between 10 and 25 wt. %, or between 15 and 24 wt. %.

The total amount of the heavy petroleum oil and the lignin oil may e.g. be at least 95 wt. %, at least 98 wt. %, at least 99 wt. %, at least 99.5 wt. %, at least 99.9 wt. % or 100 wt. % of the composition.

Process for Making the Composition

WO2021/064047 discloses a fractionation process of a lignin-rich feedstock to produce a crude liquid lignin oil comprising lignin oligomers having a number average molecular mass of between 400 and 1000 g/mol. The process is performed using a polar organic solvent such as an alcohol selected from methanol, ethanol and butanol and an inorganic acid, which remains in the obtained product. The process also obtains methylated C5 sugars.

The presence of the alcohol in the obtained product of WO 2021/064047 does not allow it to blend well with heavy petroleum oils to make a homogeneous blend. However, it was surprisingly found that the obtained product of WO 2021/064047 blends well with heavy petroleum oils after the alcohol is removed, resulting in less or smaller particles in the composition compared to polymeric lignins or lignin oligomers without methylated C5 sugars.

Accordingly, the product obtained according to the process of WO 2021/064047 can be advantageously used as the source of the composition of the present invention.

The product obtained according to the process of WO 2021/064047 may be treated to extract the methylated sugar. The skilled person knows suitable ways to perform the extraction. The extracted methylated sugar may be blended with a heavy petroleum oil. Further a lignin oligomer is added to obtain the composition of the invention.

The product obtained according to the process of WO 2021/064047 may be treated to remove the alcohol. The resulting viscous lignin oil product comprises a lignin oligomer and a methylated sugar, which can be blended with a heavy petroleum oil.

The product obtained according to the process of WO 2021/064047 may be separated to obtain a first fraction comprising the lignin oligomer and a second fraction comprising the methylated sugar and the polar organic solvent. After removing the polar organic solvent from the second fraction, the obtained product may be blended with a heavy petroleum oil. Further a lignin oligomer is added. The lignin oligomer may be the first fraction mentioned above.

Thus, the present invention provides a process for preparing the composition according to any one of the preceding claims, comprising the steps of:

i) preparing a crude liquid lignin oil comprising the lignin oligomers, the methylated C5 sugar and an alcohol selected from methanol, ethanol and butanol and combinations thereof, ii) obtaining a substantially alcohol free fraction from the crude liquid lignin oil and iii) blending the substantially alcohol free fraction with the heavy petroleum oil.

In some embodiments of the present invention, step ii) involves extracting the methylated C5 sugar from the crude liquid lignin oil and step iii) involves blending the extracted C5 methylated sugar with the heavy petroleum oil and a further lignin oligomer. The lignin oligomer may or may not be a lignin oligomer obtained from the crude liquid lignin oil.

In some embodiments of the present invention, step ii) involves removing the alcohol from the crude liquid lignin oil to obtain the substantially alcohol free fraction.

In some embodiments of the present invention, step ii) involves separating the crude liquid lignin oil to obtain a first fraction comprising the lignin oligomer and a second fraction comprising the methylated sugar and the alcohol and removing the alcohol from the second fraction to obtain a third fraction and step iii) involves blending the third fraction with the heavy petroleum oil. In some embodiments of the present invention, the process further comprises the step of adding the first fraction to the blend obtained by step iii).

Preferably, step i) comprises treating a lignocellulosic feedstock with the alcohol in the presence of an inorganic acid and an added gas.

Preferably, the treatment is conducted at an operating temperature between 100° C. and 210° C., at an operating pressure lower than 200 bar and at least 1 bar above the vapour pressure of the alcohol at the operating temperature, a residence time up to 240 minutes, wherein the amount of water in the process (the amount of water in the reaction mixture) is less than 10 wt. %, and wherein the ratio (w/w) of lignin (in lignocellulosic feedstock) to the alcohol ranges between 1:1.5 and 1:9.

Step i) is explained in detail in WO 2021/064047, incorporated herein by reference.

The methylated sugar is distributed in deep cell walls of lignocellulosic materials. The treatment results in the depolymerization of lignin polymers in the lignocellulosic feedstock into lignin oligomers as well as the extraction of the methylated sugars present in deep cell walls of the lignocellulosic feedstock. Accordingly, a composition is obtained comprising lignin oligomers and methylated sugars. As alcohol is used in the treatment, said composition further comprises the alcohol.

The lignocellulosic feedstock may e.g. be hardwood or softwood in the form of chips or sawdust. In step i), this may be provided in a reactor vessel, to which the alcohol and the inorganic acid are added as well as a gas.

Preferably, the inorganic acid is chosen from sulfuric acid, hydrochloric acid, or phosphoric acid, preferably wherein the inorganic acid is chosen from sulfuric acid or hydrochloric acid.

Preferably, the amount of inorganic acid ranges between 0.1 and 0.7 wt. % relative to the lignocellulosic feedstock, preferably between 0.2 and 0.4 wt. % relative to the lignocellulosic feedstock.

Preferably, the added gas is chosen from nitrogen, air or hydrogen.

Preferably, the operating temperature is between 140° C. and 200° C.

Preferably, the operating pressure is at least 2 bar above the vapour pressure of the organic solvent, preferably at least 5 bar above the vapour pressure of the organic solvent, more preferably at least 10 bar above the vapour pressure of the organic solvent, and wherein the operating pressure is lower than 100 bar, preferably lower than 50 bar.

Preferably, the residence time is up to 200 minutes, preferable up to 160 minutes, more preferably up to 120 minutes.

Preferably, the ratio (w/w) of lignin (in lignocellulosic feedstock) to the alcohol ranges between 1:2 and 1:7, preferably between 1:2.3 and 1:6.3.

Preferably, the amount of water in the process is less than 5 wt. %, preferably between 0.5 and 4 wt. %, of the total weight.

Preferably, the crude liquid lignin oil obtained by step i) comprises lignin oligomers and methylated sugars wherein the ratio (w/w) of lignin oligomers to methylated sugars ranges between 1:1 and 2.5:1, preferably between 1.6:1 and 2:1.

Preferably, in the crude liquid lignin oil obtained by step i), the number average molecular mass of the lignin oligomers ranges between 400 and 1000 g/mol. Preferably, the methylated sugars are selected from methyl-pentopyranoside, methyl-D-gluconpyranoside, methyl-D-xylopyranoside, methyl 3-O-acetylpentopyranoside, dimethyl-4-O-methyl-hexanopyroside and a mixture thereof.

Preferably, in the crude liquid lignin oil obtained by step i), the amount of the alcohol ranges between 1 and 30 wt % relative to the total weight of the crude liquid lignin oil, wherein the solvent preferably is methanol.

Preferably, in the crude liquid lignin oil obtained by step i), the amount of lignin and the methylated sugars is between 30 and 80 wt. % of the CLO, excluding any solvent.

Preferably, in the crude liquid lignin oil obtained by step i), the lignin oligomers have a Tg lower than 82.5° C. as measured with DSC (10K/min).

It is noted that the invention relates to the subject-matter defined in the independent claims alone or in combination with any possible combinations of features described herein, preferred in particular are those combinations of features that are present in the claims. It will therefore be appreciated that all combinations of features relating to the composition according to the invention; all combinations of features relating to the process according to the invention and all combinations of features relating to the composition according to the invention and features relating to the process according to the invention are described herein.

It is further noted that the term 'comprising' does not exclude the presence of other elements. However, it is also to be understood that a description on a product/composition comprising certain components also discloses a product/composition consisting of these components. The product/composition consisting of these components may be advantageous in that it offers a simpler, more economical process for the preparation of the product/composition. Similarly, it is also to be understood that a description on a process comprising certain steps also discloses a process consisting of these steps. The process consisting of these steps may be advantageous in that it offers a simpler, more economical process.

When values are mentioned for a lower limit and an upper limit for a parameter, ranges made by the combinations of the values of the lower limit and the values of the upper limit are also understood to be disclosed.

DETAILED DESCRIPTION OF THE INVENTION

The invention is now elucidated by way of the following examples, without however being limited thereto.

Comparative Experiment 1

Figure 1:
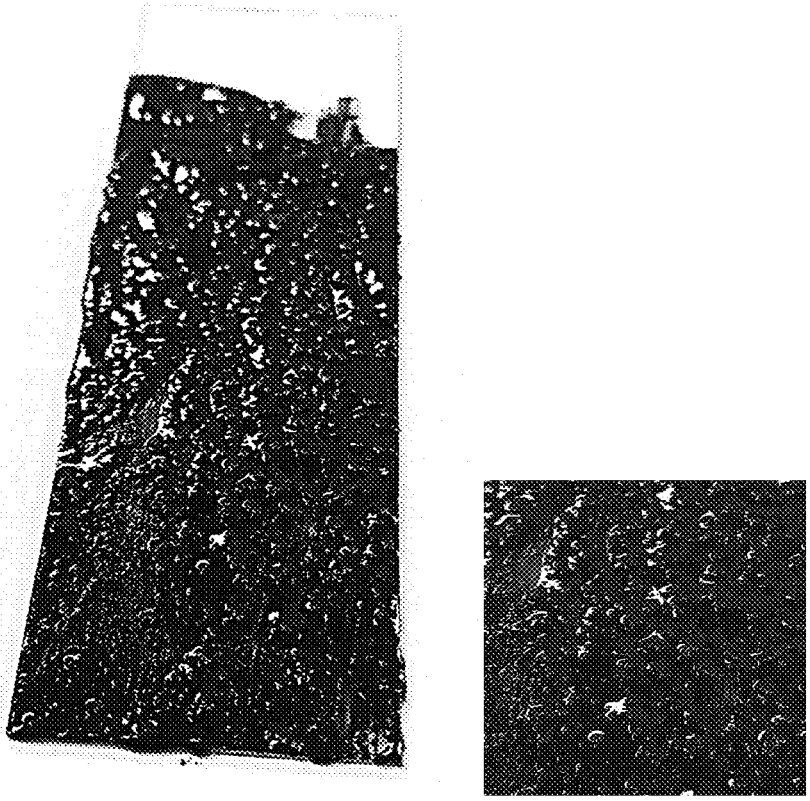
FIG. 1 Dispersion of particles prepared in Comp Exp 1
FIG. 2 Dispersion of particles prepared in Comp Exp 2
FIG. 3 Dispersion of particles prepared in Comp Exp 3
FIG. 4 Dispersion of particles prepared in Exp 4
FIG. 5 GPC of the methylated C5 sugar fraction of the lignin oil used in example 4.

4 g of technical lignin PB1000 were added in a round bottom flask, together with 16 g of heavy fuel oil (HFO). The PB1000 lignin has number average (Mn) molecular weight>1000 g/mol and weight average molecular weight>4000 g/mol. The particle size of the lignin was approx. 210 micron. The flask was transferred to an oil bath of 60° C. and was mixed rigorously for 15 minutes. Then, a representative sample was taken and added onto a glass plate for visual observation on the amount and nature of solid particles in the mixture composition. It is visually obvious that a dispersion with high number of large particles is present. A photo of the representative sample is shown in FIG. 1.

Comparative Experiment 2

Figure 2:
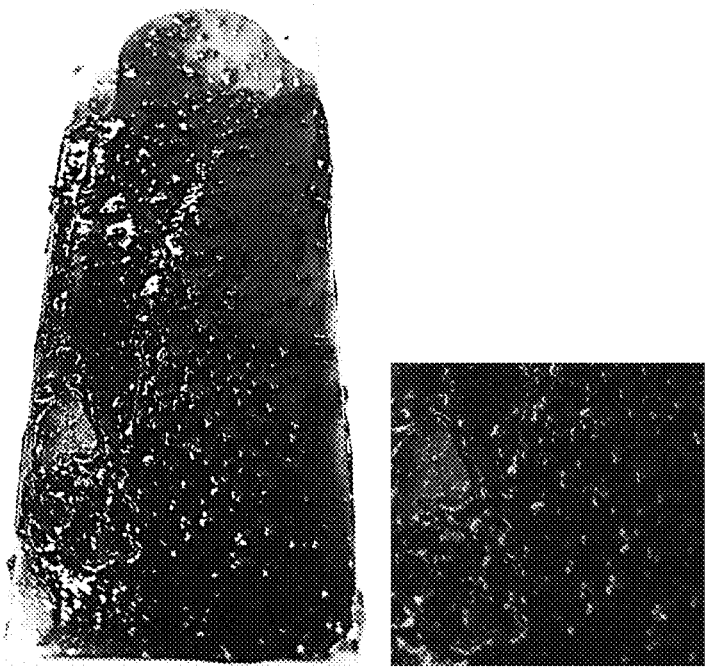

4 g of technical lignin PB1000 were added in a round bottom flask, together with 16 g of vacuum gas oil (VGO). The flask was transferred to an oil bath of 60° C. and was mixed rigorously for 15 minutes. The PB1000 lignin has number average (Mn) molecular weight>1000 g/mol and weight average molecular weight>4000 g/mol. The particle size of the lignin was approx. 210 micron. Then, a representative sample was taken and added onto a glass plate for visual observation on the amount and nature of solid particles in the mixture composition. It is visually obvious that a dispersion with high number of large particles is present. A photo of the representative sample is shown in FIG. 2.

Comparative Experiment 3

Figure 3:
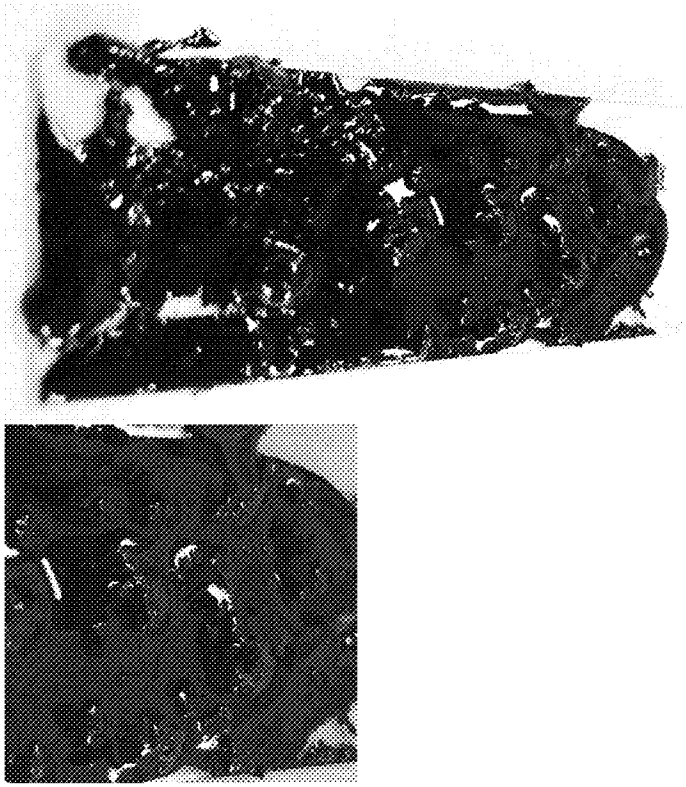

Lignin oligomers were produced after solvolysis of PB1000 in methanol according to the process described in WO 2019053287A1. The lignin oligomers were produced after mild depolymerization of PB1000 in methanol, 200° C., 30 minutes reaction time and lignin:methanol ratio of 1:10 w/w. After reaction the product mixture was subjected to solid/liquid separation step (such as filtration) or centrifugation to separate insoluble solids. Then the liquid mixture of methanol and soluble lignin oligomers was subjected to vacuum distillation to isolate the solid fraction of lignin oligomers and remove all the solvent. The lignin oligomers have Mn of 1342 g/mol, and dispersity of 1.48. The Glass transition temperature of these lignin oligomers is 82.9±1° C. 4 gr of the solid lignin oligomers were added in a round bottom flask, together with 16 g of vacuum gas oil (VGO). The flask was transferred to an oil bath of 60° C. and was mixed rigorously for 15 minutes. Then, a representative sample was taken and added onto a glass plate for visual observation on the amount and nature of solid particles in the mixture composition. It is visually obvious that a dispersion with larger agglomerates is present in the fuel composition. A photo of the representative sample is shown in FIG. 3.

Example 4

Figure 4:
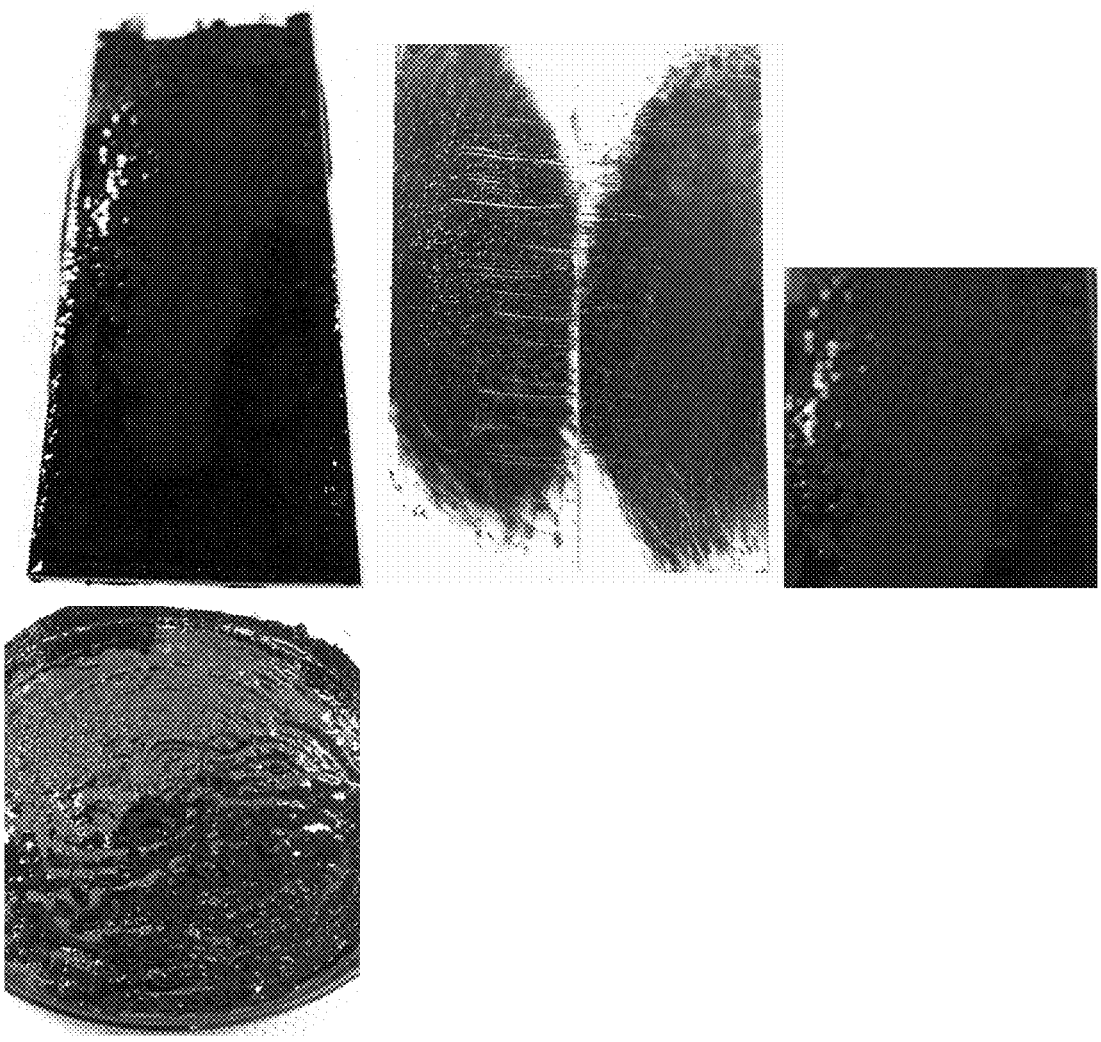

The product obtained according to the process of WO 2021/064047 was subjected to vacuum distillation in order to remove all the alcohol solvent. The product is a viscous lignin oil composition. 4 g of the lignin oil (comprising lignin oligomers and methylated C5 sugars (no solvent)) were added together with 16 g of HFO into a round bottom flask. The flask was transferred to an oil bath of 60° C. and was mixed rigorously for 15 minutes. Then, a representative samples was taken and added onto a glass plate for visual observation on the amount and nature of solid particles in the mixture composition. It is visually obvious that less or smaller particles were present in the fuel mixture composition. A photo of the representative sample is shown in FIG. 4.

The methylated C5 sugars present in the lignin oil were analysed with GPC and NMR.

Figure 5:
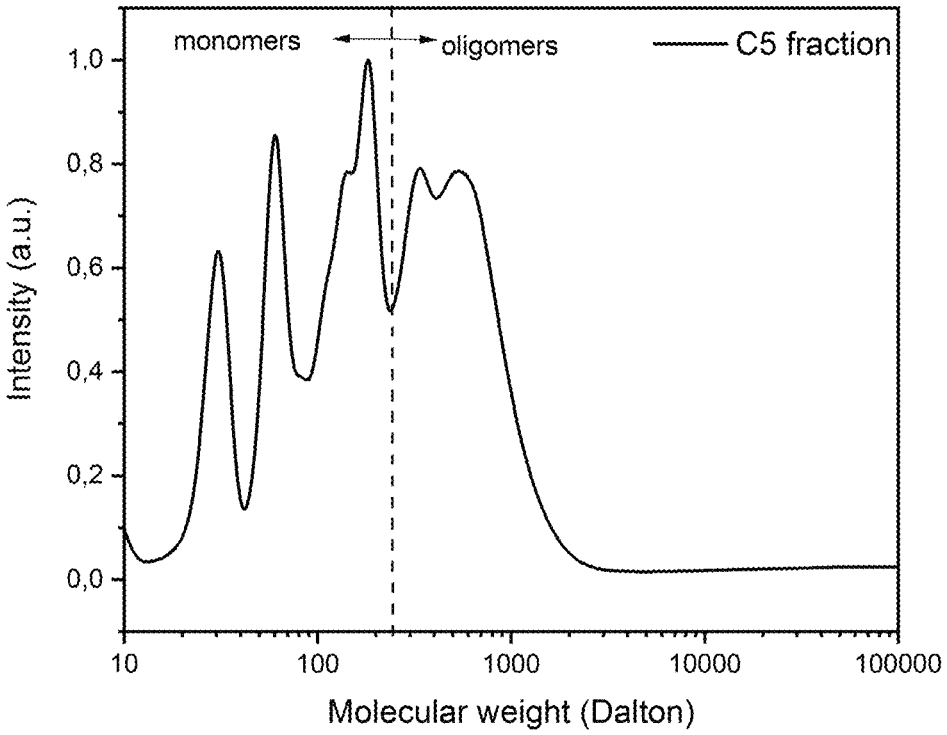

Table 1 shows the sugars present in the methylated C5 sugar fraction. FIG. 5 shows the GPC of the methylated C5 fraction.

TABLE 1

Compositional Analysis

| Component | Sugars Concentration (% dm) |
|---|---|
| Mannitol (total by NREL method) (% dm) | 0.56 |
| Fucose (total by NREL method) (% dm) | 0.37 |
| Rhamnose (total by NREL method) (% dm) | 1.10 |
| Arabinose (total by NREL method) (% dm) | 2.84 |
| Galactose (total by NREL method) (% dm) | 4.43 |
| Glucose (total by NREL method) (% dm) | 20.8 |
| Xylose (total by NREL method) (% dm) | 32.2 |
| Fructose (total by NREL method) (% dm) | <0.44 |
| Ribose (total by NREL method) (% dm) | <0.22 |
| Galacturonic acid (total by NREL method) (% dm) | 2.25 |
| Guluronic acid (total by NREL method) (% dm) | <0.11 |
| Glucuronic acid (total by NREL method) (% dm) | <0.11 |
| Mannuronic acid (total by NREL method) (% dm) | <0.05 |
| Iduronic acid (total by NREL method) (% dm) | <0.21 |

What is claimed is:

1. A composition, comprising:
a heavy petroleum oil, and
a lignin oil containing lignin oligomers and methylated sugars, and
wherein the lignin oligomer has a number average molecular mass between 400 and 1000 g/mol.

2. The composition according to claim 1, wherein the amount of the lignin oil is 0.1 wt. % to 30 wt. % with respect to the composition.

3. The composition according to claim 1, wherein the heavy petroleum oil is selected from heavy fuel oil, vacuum gas oil, lubrication oil and mixtures thereof.

4. The composition according to claim 1, wherein the methylated sugars comprise methylated C5 sugars and optionally methylated C6 sugars, and wherein the amount of methylated C5 sugars is at least 50 wt. % of the methylated sugars.

5. The composition according to claim 1, wherein the methylated sugar is selected from the group consisting of methyl-pentopyranoside, methyl-D-glucopyranoside, methyl-D-xylopyranoside, methyl 3-O-acetylpentopyranoside, dimethyl-4-O-methyl-hexanopyroside and mixtures thereof.

6. The composition according to claim 1, wherein the composition comprises little or no amount of alcohols selected from methanol, ethanol and butanol.

7. The composition according to claim 1, wherein the total amount of the heavy petroleum oil and the lignin oil is at least 95 wt. % of the composition.

8. A process for preparing the composition according to claim 1, comprising the steps of:

i) preparing a crude liquid lignin oil comprising the lignin oligomer, the methylated sugar and an alcohol selected from methanol, ethanol and butanol and combinations thereof, ii) obtaining a substantially alcohol free fraction from the crude liquid lignin oil and iii) blending the substantially alcohol free fraction with the heavy petroleum oil.

9. The process according to claim 8, wherein step ii) involves extracting the methylated sugar from the crude liquid lignin oil and step iii) involves blending the extracted methylated sugar with the heavy petroleum oil and the lignin oligomer.

10. The process according to claim 8, wherein step ii) involves removing the alcohol from the crude liquid lignin oil to obtain the substantially alcohol free fraction.

11. The process according to claim 8, wherein step ii) involves separating the crude liquid lignin oil to obtain a first fraction comprising the lignin oligomer and a second fraction comprising the methylated C5/C6 sugar and the alcohol and removing the alcohol from the second fraction to obtain a third fraction and step iii) involves blending the first fraction and the third fraction with the heavy petroleum oil.

12. The process according to claim 8, wherein step i) comprises treating a lignocellulosic feedstock with the alcohol in the presence of an inorganic acid and an added gas.

13. The process according to claim 12, wherein the treatment is conducted at an operating temperature between 100° C. and 210° C., at an operating pressure lower than 200 bar and at least 1 bar above the vapour pressure of the alcohol at the operating temperature, a residence time up to 240 minutes, wherein the amount of water in the process is less than 10 wt. %, and wherein the ratio (w/w) of lignin (in lignocellulosic feedstock) to the alcohol ranges between 1:1.5 and 1:9.

14. A method for increasing dispersion of a blend of a heavy petroleum oil and lignin oligomers, comprising the step of:

providing a methylated C5 sugar to the blend of heavy petroleum and lignin oligomers which thereby increases dispersion of the blend.

15. The composition according to claim 2, wherein the heavy petroleum oil is selected from heavy fuel oil, vacuum gas oil, lubrication oil and mixtures thereof, and wherein the methylated sugars comprise methylated C5 sugars and optionally methylated C6 sugars, and wherein the amount of methylated C5 sugars is at least 50 wt. % of the methylated sugars.

16. The composition according to claim 15, wherein the methylated sugar is selected from the group consisting of methyl-pentopyranoside, methyl-D-glucopyranoside, methyl-D-xylopyranoside, methyl 3-O-acetylpentopyranoside, dimethyl-4-O-methyl-hexanopyroside and mixtures thereof.

17. The composition according to claim 16, wherein the composition comprises little or no amount of alcohols selected from methanol, ethanol and butanol, preferably the total amount of said alcohols is at most 1 wt. % with respect to the composition, and wherein the total amount of the heavy petroleum oil and the lignin oil is at least 95 wt. % of the composition.

18. A process for preparing the composition according to claim 17, comprising the steps of:

i) preparing a crude liquid lignin oil comprising the lignin oligomer, the methylated sugar and an alcohol selected from methanol, ethanol and butanol and combinations thereof, ii) obtaining a substantially alcohol free fraction from the crude liquid lignin oil and iii) blending the substantially alcohol free fraction with the heavy petroleum oil.

19. The process according to claim 18, wherein step i) comprises treating a lignocellulosic feedstock with the alcohol in the presence of an inorganic acid and an added gas, and wherein the treatment is conducted at an operating temperature between 100° C. and 210° C., at an operating pressure lower than 200 bar and at least 1 bar above the vapour pressure of the alcohol at the operating temperature, a residence time up to 240 minutes, wherein the amount of water in the process is less than 10 wt. %, and wherein the ratio (w/w) of lignin (in lignocellulosic feedstock) to the alcohol ranges between 1:1.5 and 1:9.

20. The composition according to claim 2, wherein the amount of the lignin oil is between 10 and 25 wt. % with respect to the composition.

21. The composition according to claim 6, wherein the total amount of said alcohols is at most 1 wt. % with respect to the composition.

22. The composition according to claim 7, wherein the total amount of the heavy petroleum oil and the lignin oil is at least 99 wt. % of the composition.

23. The composition according to claim 7, wherein the total amount of the heavy petroleum oil and the lignin oil is at least 99.9 wt. % of the composition.

* * * * *